US008028380B2

(12) United States Patent
Lin

(10) Patent No.: US 8,028,380 B2
(45) Date of Patent: Oct. 4, 2011

(54) SHEET RETAINER

(75) Inventor: Bo-Yang Lin, Richardson, TX (US)

(73) Assignee: Bo-Yang Lin, Richardson, TX (US)

( * ) Notice: Subject to any disclaimer, the term of this patent is extended or adjusted under 35 U.S.C. 154(b) by 712 days.

(21) Appl. No.: 11/897,274

(22) Filed: Aug. 30, 2007

(65) Prior Publication Data

US 2009/0056085 A1 Mar. 5, 2009

(51) Int. Cl.
*A44B 21/00* (2006.01)
*B65D 33/30* (2006.01)

(52) U.S. Cl. ..... 24/303; 29/428; 29/439; 29/440; 220/495.08; 220/495.11; 248/101; 4/655

(58) Field of Classification Search ..... 220/476, 220/480, 481, 482, 23.89, 23.86, 23.83, 495.08, 220/495.06, 908.1, 908; 24/303, 460, 462; 248/206.5, 309.4, 442.2, 95, 99, 100, 101, 248/304; 29/438, 439, 450
See application file for complete search history.

(56) References Cited

U.S. PATENT DOCUMENTS 3,205,547 A * 9/1965 Riekse ..... 24/462
3,773,286 A 11/1973 Govoni et al.
3,783,931 A * 1/1974 Assael ..... 160/327
4,243,335 A 1/1981 Singley
4,566,236 A * 1/1986 Pound ..... 52/222
4,630,752 A * 12/1986 DeMars ..... 220/495.08
4,698,880 A * 10/1987 Hamm ..... 24/72.5
4,765,579 A * 8/1988 Robbins et al. ..... 248/101
5,149,028 A * 9/1992 Blackaby et al. ..... 248/101
5,388,314 A * 2/1995 Vella ..... 24/555
5,518,136 A * 5/1996 Muldner et al. ..... 220/495.11
5,613,282 A * 3/1997 Deddens et al. ..... 24/30.5 R
5,645,186 A 7/1997 Powers et al.
5,671,861 A 9/1997 Hall et al.
5,740,939 A * 4/1998 Muldner et al. ..... 220/495.11
6,484,374 B2 11/2002 McAllister
6,609,258 B1 * 8/2003 Clements ..... 4/655
6,820,288 B2 * 11/2004 Suitsu ..... 4/483
7,055,224 B2 6/2006 Bathey
2006/0096988 A1 * 5/2006 Kim ..... 220/495.08
2006/0236509 A1 * 10/2006 Ausman ..... 24/303
2008/0179330 A1 7/2008 Brooks et al.

* cited by examiner

*Primary Examiner* — Robert Sandy
*Assistant Examiner* — Rowland D Do

(57) ABSTRACT

A method for easy holding of a trash bag in a container: It consists of at least one retainer set and a container having an open end. Each retainer set consists of at least two magnetically coupled pieces which can engage or disengage with each other, with one of the two pieces attached rigidly to an outside portion of the container. Place a portion of a trash bag inside the container with the outside portion of the trash bag folded down along the trash can wall. Engage the two magnetically coupled pieces to fold part of the trash bag around them. The folding(s) reduces the force needed to hold the trash bag in place at the coupling portion of the two retainer pieces. The apparatus can be easily operated with one hand.

6 Claims, 6 Drawing Sheets

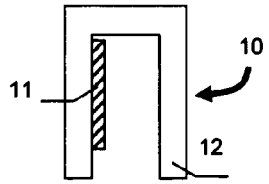
FIG. 15
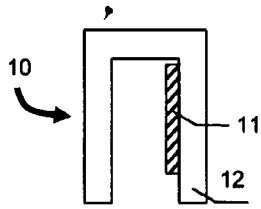
FIG. 16
FIG. 17a
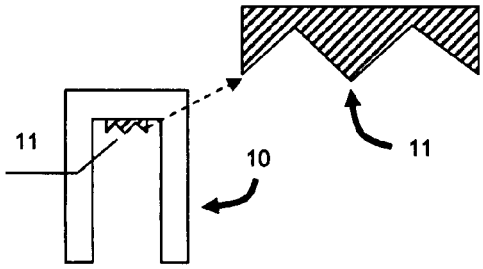
FIG. 17
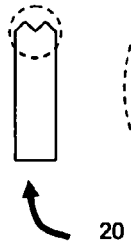
FIG. 18
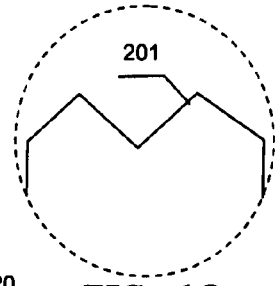
FIG. 18a
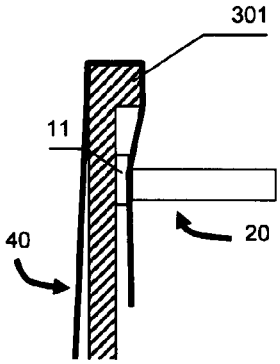
FIG. 19
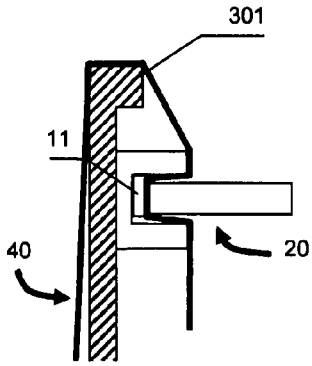
FIG. 20
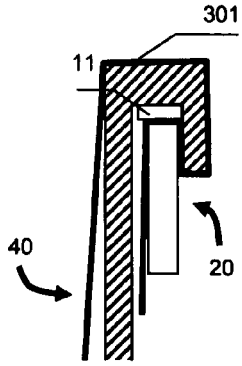
FIG. 21

SHEET RETAINER

CROSS-REFERENCE TO RELATED APPLICATIONS (Not Applicable)

STATEMENT REGARDING FEDERALLY SPONSORED RESEARCH/DEVELOPMENT (Not Applicable)

BACKGROUND OF THE INVENTION

As is often desired, one needs to attach a sheet to a solid structure so that the sheet, or a portion of it, does not move with respect to the solid structure. An example is the attachment of a trash bag to a trash can. To keep a trash can clean and for easy trash removal, a trash bag is typically used inside a trash can. Trash bags are notoriously known for easily falling into a trash can when material is placed inside of them. As a result, the material may fall outside of the trash bag and into the space between the trash bag and the trash can, which makes it difficult to pick the material up. When the material is trash, it can also make the trash can dirty.

Many trash bag and retainer designs have been introduced in the past in order to solve the problem of a trash bag falling into a trash can. Prior arts include many different designs to hold the trash bag in place, for example, tabs inside a trash can (U.S. Pat. No. 3,825,150); an elastic band (U.S. Pat. No. 4,338,979); elastic band with protruding structures (U.S. Pat. No. 7,055,224); handles on a trash bag attached to holders on a trash can (U.S. Pat. No. 4,437,634); a wire frame (U.S. Pat. No. 4,623,111); side bars for supporting handled trash bags (U.S. Pat. No. 5,054,724); interlocked rings (U.S. Pat. No. 5,062,533); clips (U.S. Pat. No. 5,645,186); two handles (U.S. Pat. No. 5,671,861); clamps designed into a trashcan (U.S. Pat. No. 6,484,374). These inventions and others have advanced the art, but are still not convenient enough. The object of the invention is to device a design so that the attachment of a sheet to a solid structure, such as the attachment of a trash bag to a trash can, can be easily made.

BRIEF SUMMARY OF THE INVENTION

The present invention relates to the usage of a retainer or a set of retainers for the attachment of a sheets or a bag to a solid structure. An example is the attachment of a trash bag to a trash can. For simplicity sake and unless otherwise stated, we use trash bags and trash cans for the general discussion of this invention.

The aforementioned retainer consists of two pieces: One of them is attached rigidly to the trash can, while the other can engage or disengage with the 1$^{st}$ piece. When engaged with each other, with a portion of the trash bag sandwiched in between, the two pieces prevent the trash bag from slipping into the trash can. In the present invention, the engagement of the two pieces may be by means of magnetism. The present invention can be operated easily with a single hand, making it very convenient to use.

BRIEF DESCRIPTION OF THE DRAWINGS

FIGS. 15-17 illustrate three of the alternative embodiments of the 1$^{st}$ piece (10) of the holding device.

FIG. 17*a* is an enlargement of piece 11 in FIG. 17.

FIG. 18 is the corresponding embodiment of the 2$^{nd}$ piece (20) of the holding device with respect to FIG. 17.

FIG. 18*a* is an enlargement of the top portion of FIG. 18.

FIGS. 19-26 illustrate some of the alternative designs of the present embodiment.

DETAILED DESCRIPTION OF THE INVENTION

Figure 1:
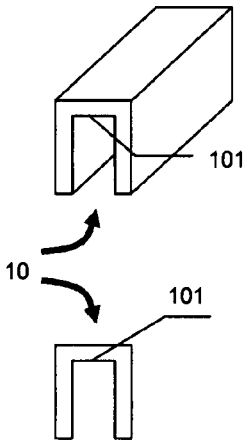
FIG. 1 is a three dimensional and front view of the 1$^{st}$ piece (10) of the holding device.
Figure 2:
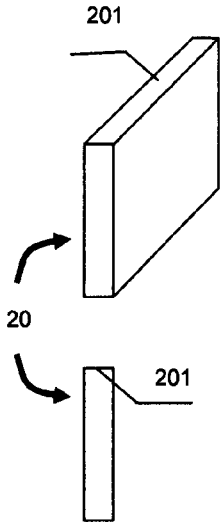
FIG. 2 is a three dimensional and front view of the 2$^{nd}$ piece (20) of the holding device.
Figure 3:
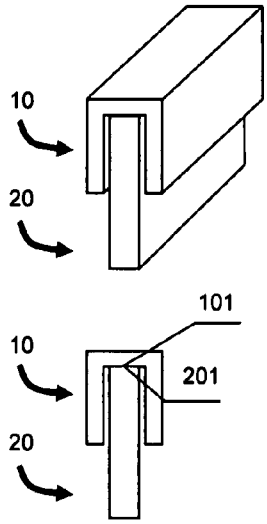
FIG. 3 is a three dimensional and front view of the 1$^{st}$ and 2$^{nd}$ piece (10 & 20) of the holding device engaged with each other.
Figure 4:
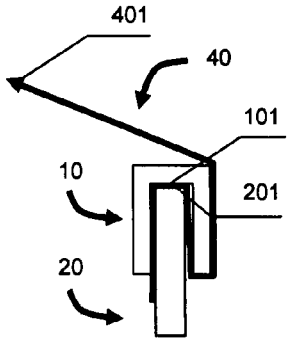
FIG. 4 illustrates how the holding device works.

Drawings herein are for purposes of illustrating the preferred embodiments of the present invention only, not to limit the present invention. There are no dimensional specifications in these drawings so that the dimensions may be altered to fit with specific applications. FIGS. 1&2 are a three dimensional and front view of the 1$^{st}$ (10) and 2$^{nd}$ (20) piece of the holding device. The inside top surface (101) of the 1$^{st}$ piece (10) attracts the 2$^{nd}$ piece (20) magnetically. The details of how this works will be discussed later. FIG. 3 shows the engagement of the 1$^{st}$ (10) and 2$^{nd}$ (20) piece of the holding device. They are held together by the magnetic force between them. As shown in FIG. 4, when pieces 10 and 20 are engaged with each other, they may capture a portion of a trash bag (40) in between. The magnetic force between the inside top surface (101) of the 1$^{st}$ piece (10) and the 2$^{nd}$ piece (20) holds the trash bag (40) in place and prevents it from slipping away when the trash bag (40) is pulled at its end (401). The strength of magnetic force between the two pieces of the holding device should be such that they hold the trash bag in place while allowing for easy separation of the two pieces when needed.

Figure 5:
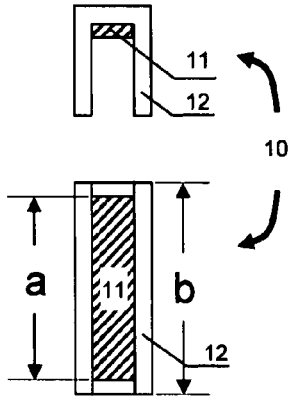
FIG. 5 is a front and bottom view of one embodiment of the 1$^{st}$ piece (10) of the holding device.

In one embodiment (FIG. 5), piece 10 consists of two portions: one (11) is made of a magnet or a piece of magnetic material and the other (12) is made of a non-magnetic material. Piece 11 is attached to the underside of piece 12. The upper portion of FIG. 5 is the front view of the piece 10, while the lower portion of FIG. 5 is the bottom view of the piece 10. In this embodiment, piece 20 (FIG. 2) is made of a magnet or a piece of magnetic material so that the top of piece 20 (201 in FIG. 2) is attracted to piece 11 of piece 10 in FIG. 5. As shown in FIG. 5, length a and b do not have to be the same.

Figure 6:
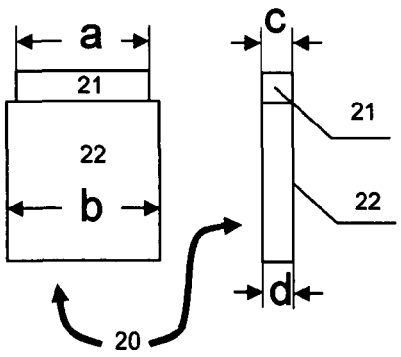
FIG. 6 is a front and side view of one embodiment of the 2nd piece (20) of the holding device.
Figure 7:
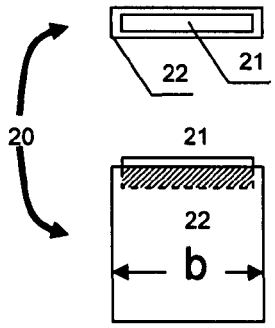
FIG. 7 is a front and side view of another embodiment of the 2nd piece (20) of the holding device.

In another embodiment (FIG. 6), piece 20 consists of a top piece (21) and bottom piece (22). Piece 22 is made of none magnetic material. Piece 21 is made of a magnet or a magnetic material so that piece 21 is attracted to piece 11 of 10 in FIG. 5. Length a and b in FIG. 6 do not have to be the same; neither do width c and d in FIG. 6. Piece 21 may also be recessed partly into piece 22 as shown in FIG. 7, where the top portion of FIG. 7 is the top view and the bottom portion is the front view.

Figure 8A:
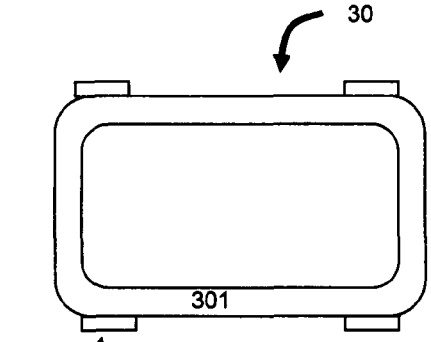
FIG. 8*a* is the enlargement of a corner of the trash can in FIG. 8 with a 1$^{st}$ piece (10) of the holding device attached.
Figure 8A:
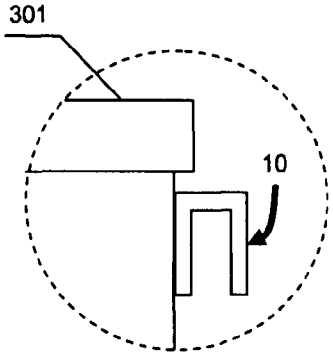
Figure 8:
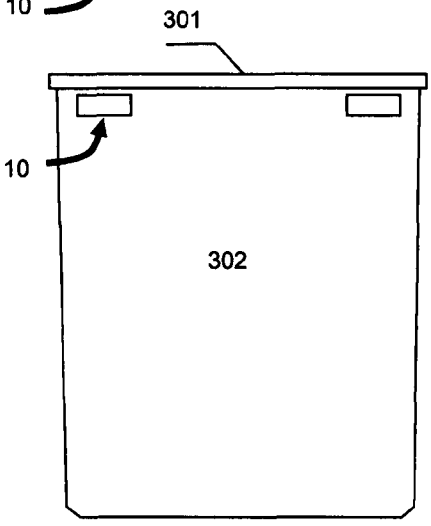
FIG. 8 has three drawings located at the top, bottom and bottom-right, corresponding to the top, front and side view of a trash can with four of the 1$^{st}$ piece (10) of the holding device attached.
Figure 8:
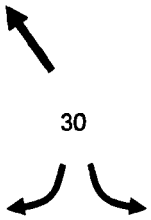
Figure 8:
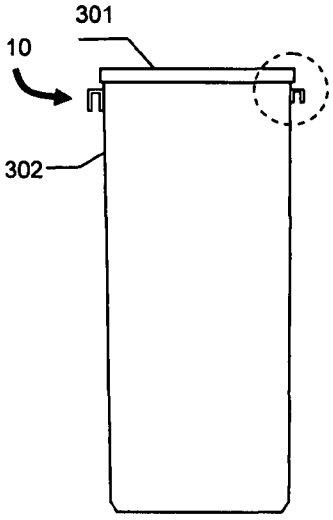

FIG. 8 consists of three separate drawings located at the top, bottom and bottom-right, corresponding to the top, front and side view of a trash can with four of the 1st piece (10) of the holding device attached.

FIG. 8*a* is the enlargement of a corner of the trash can in FIG. 8 with a 1st piece (10) of the holding device attached to the outside wall of the trash can.

Figure 9:
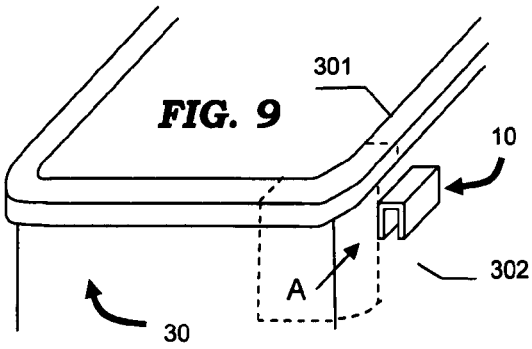
FIG. 9 is the three dimensional view of part of the top portion of a trash can with the 1$^{st}$ piece (10) of the holding device attached to the outside wall (302).
Figure 10:
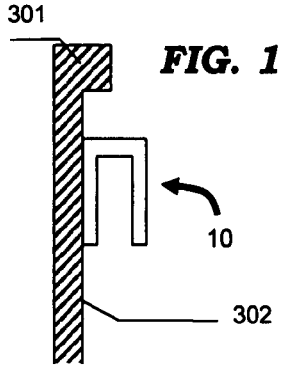
FIG. 10 is an enlarged front view (view A in FIG. 9) after a portion of the trash can is cut open along the broken line in FIG. 9.

FIG. 9 is the three dimensional view of part of the top portion of a trash can with the 1st piece (10) of the holding device mounted on the outside of the trash can wall (302). 301 is top rim of the trash can. FIG. 10 is an enlarged front view (view A in FIG. 9) after a portion of the trash can is cut open along the broken line in FIG. 9, showing the cross section of part of the trash can wall (302) and the top rim of the trash can (301) together with the head on view of piece 10.

Figure 11:
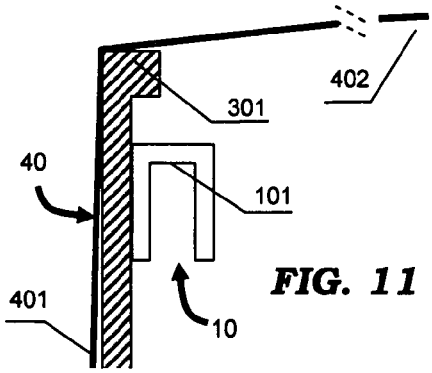
FIGS. 11-14 illustrate a sequence for engaging the 1$^{st}$ (10) and the 2$^{nd}$ piece (20) of the holding device so that they hold a portion of a trash bag in between them to prevent the said bag from slipping.
Figure 12:
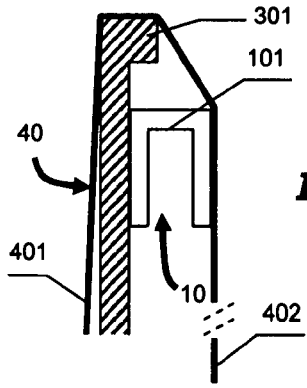
Figure 13:
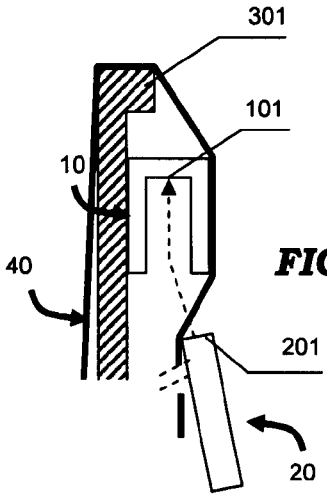
Figure 14:
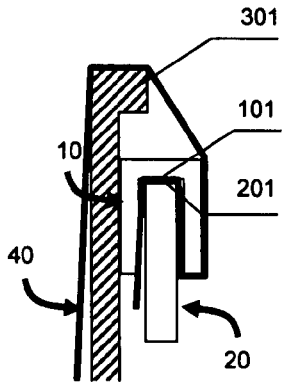

As shown in FIG. 11, to hold a trash bag, the bottom portion (401) of the trash bag (40) needs to be placed in the trash can and the top portion of the trash bag (402) should extend beyond the top rim of the trash can (301). The trash bag outside of the trash can is then folded down covering piece 10 and extents beyond it, by at least an 1", for example (FIG. 12). As shown in FIGS. 13 and 14, the top of piece 20 (201) is brought into contact with the inside top of piece 10 (101) with part of the trash bag sandwiched between 101 and 201. The magnetic force between pieces 10 and 20 holds the sandwiched portion of the trash bag in place and prevents the said trash bag from falling into the trash can.

The placement of a magnet or a magnetic material (11) in piece 10 can be at different locations from that shown in FIG. 5. It can be, e.g., on the inward sides of piece 10 as shown in FIGS. 15 and 16. Also, the outside surface of 11 in FIG. 5 may have groves for improved holding capabilities as shown in FIGS. 17 and 17*a*. In this case, the top surface 201 of piece 20 in FIG. 2 should have matching groves as shown in FIGS. 18 and 18*a*.

There are numerous variations of the present embodiment. Variations in dimension and structure may be implemented by one skilled in the art of this disclosure. Some exemplary variations are shown in FIGS. 19, 20.

FIG. 21 is still another exemplary variation of the present embodiment. In this example, the top of the cross section of the trash can (top of the shaded area in FIG. 20) is not just a straight angle, but is n-shaped as shown by the top of the shaded area in FIG. 21. A magnet or a magnetic material (11) can be attached to the underside of the n-shaped portion. Piece 20 engages with piece 11 with a portion of the trash bag sandwiched in-between as shown in FIG. 21.

Figure 22:
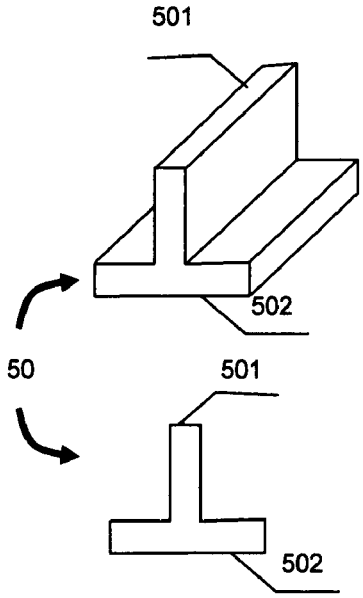
Figure 23:
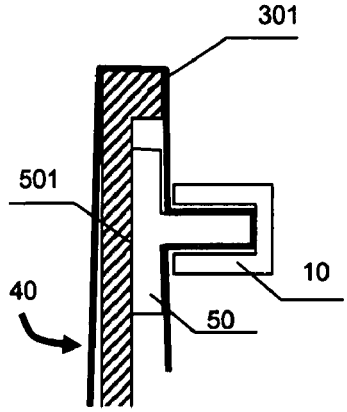

FIG. 22 is still another exemplary variation of the present embodiment. It can be used with piece 10 in FIG. 1, where the inside top of 10 (101 in FIG. 1) is attracted magnetically to the top of 50 (501) in FIG. 22. The bottom of 50 (502 in FIG. 22) is attached to the outside wall of a trash can (FIG. 23). Piece 10 engages with piece 50 with a portion of the trash bag (40) sandwiched in between as shown in FIG. 23, so as to prevent the said trash bag from falling off.

Figure 24:
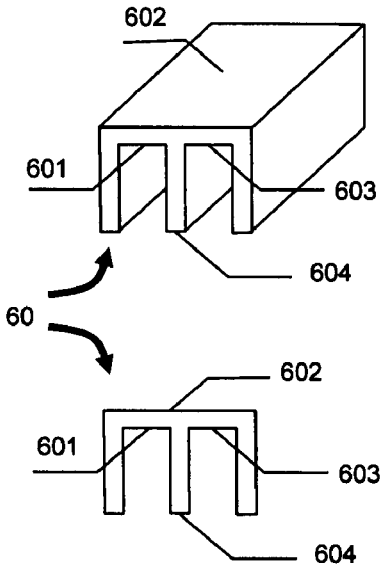
Figure 25:
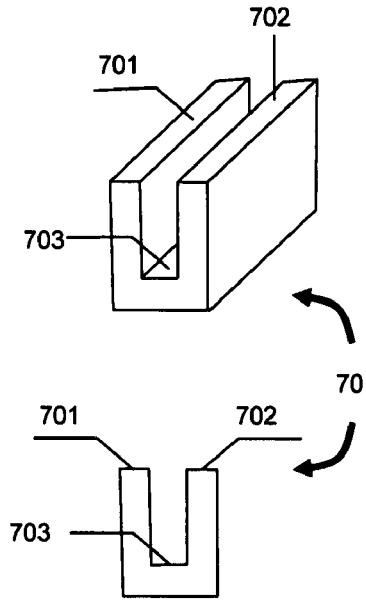
Figure 26:
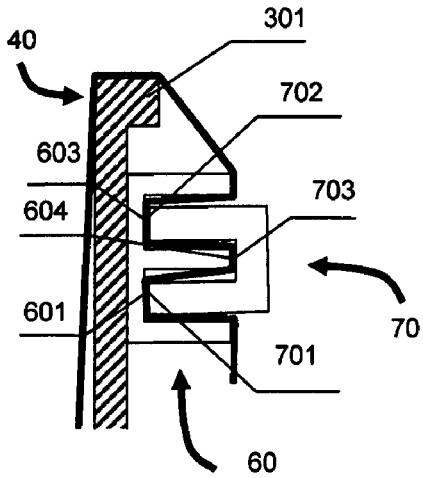

FIG. 24 and FIG. 25 are still other exemplary variations of the present embodiment. Piece 60 in FIG. 24 essentially consists of two units of piece 10 in FIG. 1. The corresponding piece 70 (FIG. 25) has two ridges (701 and 702) which are magnetically attracted to the top undersides of piece 60 (601, 603 of FIG. 24). Furthermore, if it is desired, one can make the inside top of piece 70 (703 of FIG. 25) to magnetically attract to ridge 604 of piece 60 (FIG. 24). FIG. 26 shows that piece 60 is attached to the outside wall of a trash can and piece 60 is attracted to piece 70 with a portion of the trash bag (40) sandwiched in between, so as to prevent the said trash bag from falling off.

Figure 27:
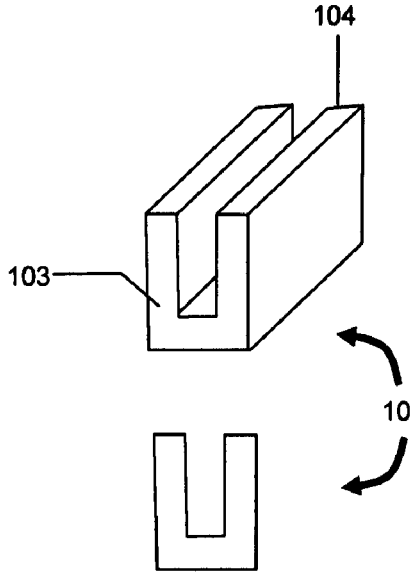
FIG. 27 shows different views of the piece 10 in FIG. 1.
Figure 28:
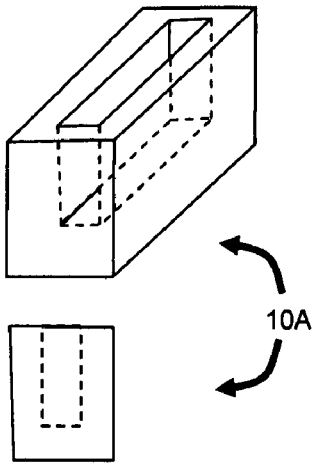
FIG. 28 illustrates an alternative embodiment of the 1st piece (10) of the holding device.

FIG. 27 is a different 3 dimensional and front view of piece 10 in FIG. 1. FIG. 28 (piece 10A) is an illustration of an exemplary variation of piece 10 where the front and back ends (103 and 104) of piece 10 in FIG. 27 are capped off. Piece 20 of FIG. 2 can fit into the cavity in piece 10A. The side caps on piece 10A keep piece 20 properly positioned with respect to piece 10A.

Illustrations above provide exemplary embodiments of the present invention. The scope of the present invention is not limited by these illustrations. The number of variations, some of which are shown in this presentation, is too many to list. These variations may be implemented by one skilled in the art in view of this disclosure.

I claim:

1. A method of attaching a trash bag to a trash can, comprising the steps of:

providing at least one retainer comprising of a first retainer piece and a second retainer piece which are magnetically coupled to each other;

affixing the first retainer piece of the two pieces to an outside wall of the trash can;

placing a body of an opened trash bag into the trash can with a top portion of the trash bag extending beyond the trash can top;

folding outwardly down the top portion of the trash bag along a trash can wall beyond the first retainer piece; and folding part of the trash bag around a portion of the first retainer piece by engaging the second retainer piece magnetically with the first retainer piece and capturing a portion of the trash bag in between a magnetically attractable surface of the first retainer piece and a magnetically attractable surface of the second retainer piece, hence attaching the trash bag to the trash can.

2. The method as claimed in claim 1 wherein the step of folding part of the trash bag around the portion of the first retainer piece by engaging the second retainer piece magnetically has a folding angle of 90 degrees.

3. The method as claimed in claim 1 wherein the step of folding part of the trash bag around the portion of the first retainer piece by engaging the second retainer piece magnetically has a folding around angle of greater than 90 degrees.

4. The method as claimed in claim 1 wherein the step of affixing of the first retainer piece to the outside wall of the trash can is accomplished by integrating the first piece into the trash can.

5. The method as claimed in claim 1 wherein the step of affixing of the first retainer piece to the outside wall of the trash can is accomplished by integrating the first retainer piece into the trash can and the folding part of the trash bag around the portion of the first retainer piece by engaging the second retainer piece magnetically has a folding around angle of 90 degrees.

6. The method as claimed in claim 1 wherein the step of affixing of the first retainer piece to the outside wall of the trash can is accomplished by integrating the first piece into the trash can and the folding part of the trash bag around the portion of the first retainer piece by engaging the second retainer piece magnetically has a folding around angle of greater than 90 degrees.

* * * * *